US007922562B2

(12) United States Patent
Ward et al.

(10) Patent No.: US 7,922,562 B2
(45) Date of Patent: Apr. 12, 2011

(54) SYSTEMS AND METHODS FOR REDUCING ELECTROSTATIC CHARGE OF SEMICONDUCTOR WAFERS

(75) Inventors: A. Trent Ward, Kuna, ID (US); Jeffrey M. Durning, Caldwell, ID (US); Sherman D. Stump, Boise, ID (US); Curtis J. Ritter, III, Boise, ID (US)

(73) Assignee: Micron Technology, Inc., Boise, ID (US)

( * ) Notice: Subject to any disclaimer, the term of this patent is extended or adjusted under 35 U.S.C. 154(b) by 601 days.

(21) Appl. No.: 11/757,911

(22) Filed: Jun. 4, 2007

(65) Prior Publication Data

US 2008/0299878 A1 Dec. 4, 2008

(51) Int. Cl.
*B24B 49/00* (2006.01)

(52) U.S. Cl. ..... 451/8; 451/41; 451/287; 438/692

(58) Field of Classification Search ..... 451/5, 8, 451/41, 285–290; 438/692
See application file for complete search history.

(56) References Cited

U.S. PATENT DOCUMENTS

| | | | | |
|---|---|---|---|---|
| 3,672,930 | A * | 6/1972 | Trachtenberg | 430/118.7 |
| 5,498,199 | A * | 3/1996 | Karlsrud et al. | 451/289 |
| 5,612,144 | A * | 3/1997 | Shinohara et al. | 428/688 |
| 6,354,479 | B1 * | 3/2002 | Reiber et al. | 228/4.5 |
| 6,537,143 | B1 * | 3/2003 | Yang et al. | 451/388 |
| 2002/0135966 | A1 * | 9/2002 | Tanaka et al. | 361/212 |
| 2002/0177518 | A1 * | 11/2002 | Kwon et al. | 501/103 |
| 2003/0045219 | A1 * | 3/2003 | Yang et al. | 451/388 |
| 2004/0127142 | A1 * | 7/2004 | Olgado | 451/5 |
| 2004/0183135 | A1 * | 9/2004 | Kwon et al. | 257/355 |
| 2004/0187451 | A1 * | 9/2004 | Suzuki et al. | 55/385.1 |
| 2005/0176349 | A1 * | 8/2005 | Yilmaz et al. | 451/8 |
| 2005/0209391 | A1 * | 9/2005 | Nakayama et al. | 524/496 |
| 2005/0254190 | A1 * | 11/2005 | Kwon et al. | 361/56 |
| 2006/0185784 | A1 * | 8/2006 | Fuentes et al. | 156/153 |
| 2008/0227374 | A1 * | 9/2008 | Schmidt et al. | 451/388 |

* cited by examiner

*Primary Examiner* — Maurina Rachuba
(74) *Attorney, Agent, or Firm* — Perkins Coie LLP

(57) ABSTRACT

A chemical-mechanical polishing machine and associated methods are disclosed. One embodiment of the machine includes a polishing pad, a wafer carrier corresponding to the polishing pad and configured to carry a semiconductor wafer, and a transfer station proximate to the polishing pad for holding the wafer during loading and/or unloading. At least one of the wafer carrier and the transfer station is configured to dissipate electrostatic charge from the wafer.

16 Claims, 5 Drawing Sheets

SYSTEMS AND METHODS FOR REDUCING ELECTROSTATIC CHARGE OF SEMICONDUCTOR WAFERS

TECHNICAL FIELD

The present disclosure generally relates to methods and apparatuses for polishing semiconductor wafers. In particular, the present disclosure relates to reducing wafer damage during and/or after polishing.

BACKGROUND

Mechanical and chemical-mechanical polishing processes (collectively, "CMP") remove material from the surfaces of semiconductor wafers in the production of microelectronic devices and other products. FIG. 1 schematically illustrates a CMP machine 10 having a platen 20, a drive assembly 26 that can rotate (as indicated by arrow F) and/or reciprocate the platen 20 (as indicated by arrow G), and a polishing pad 40 carried by the platen 20. The CMP machine 10 can also include a wafer carrier 30 for holding a semiconductor wafer 50 and an actuator assembly 36 that can rotate (as indicated by arrow J) and/or reciprocate the wafer carrier 30 (as indicated by arrow I). During polishing, the wafer carrier 30 presses the wafer 50 facedown against a polishing solution 60 on the polishing pad 40, and the platen 20 and/or the wafer carrier 30 moves to rub the wafer 50 against the polishing pad 40.

CMP polishing can normally achieve satisfactory polishing and/or planarizing results. However, one drawback with CMP polishing is that the CMP machine 10 can sometimes cause the wafers to have physical damage (e.g., delaminated surface layers, chips, etc.), defective electrical components (e.g., shorted circuitry, blown fuses, etc.), and/or other types of damage after being polished. Such damage can reduce fabrication yield and thus increase the unit cost of produced microelectronic devices. Accordingly, there is a need to reduce such damage to the polished wafers.

DETAILED DESCRIPTION

Specific details of several embodiments of the disclosure are described below with reference to a CMP machine and methods for reducing wafer damage during and/or after polishing. Several other embodiments of the CMP machine may have different configurations, components, or procedures than those described in this section. A person of ordinary skill in the art, therefore, will accordingly understand that the invention may have other embodiments with additional elements, or the invention may have other embodiments without several of the elements shown and described below with reference to FIGS. 2-4D.

Figure 1:
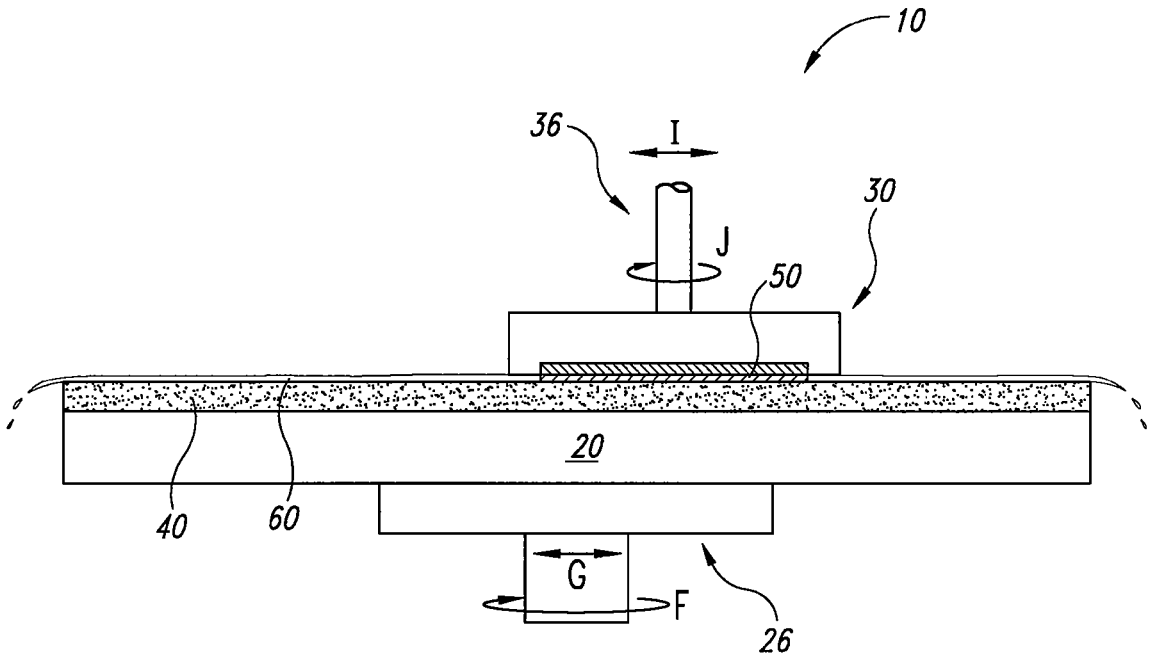
FIG. 1 is a partially schematic, cross-sectional side view of a portion of a rotary polishing machine in accordance with the prior art.
Figure 2:
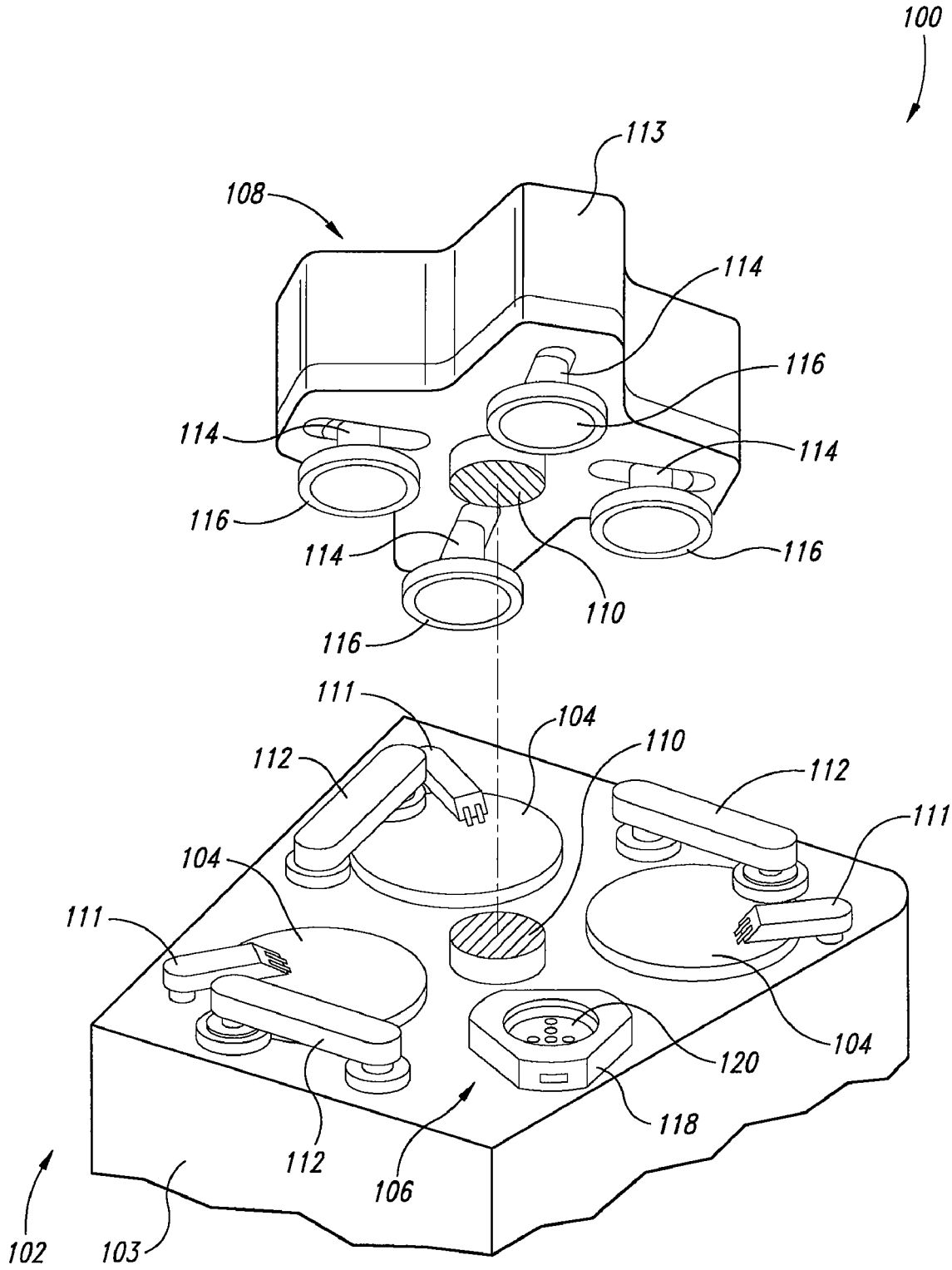
FIG. 2 is a partially schematic, isometric view of a CMP machine in accordance with an embodiment of the disclosure.

FIG. 2 is a partially schematic, isometric view of a CMP machine 100 configured to reduce wafer damage and in accordance with an embodiment of the disclosure. The CMP machine 100 can include a base portion 102, a head portion 108 spaced apart from the base portion 102, and a coupler 110 rotatably connecting the base portion 102 to the head portion 108. The coupler 110 is shown schematically in an exploded view to better illustrate the base portion 102 and the head portion 108. The coupler 110 can include a bearing, a mechanical seal, and/or other suitable coupling device.

The base portion 102 can include a chassis 103 that carries a plurality of polishing pads 104, conditioners 112 for conditioning the polishing pads 104, and slurry supplies 111 for supplying a slurry to the polishing pads 104. The chassis 103 can also carry a transfer station 106 for loading/unloading wafers (not shown) to/from the wafer carriers 116. The transfer station 106 can include a cup 118 and a pedestal 120 that is located at least partially inside the cup 118 for supporting wafers. The pedestal 120 and/or the cup 118 of the transfer station 106 can be configured to dissipate electrostatic charge from wafers placed on the pedestal 120. The transfer station 106 can also be configured to contact wafers with a gas (e.g., clean and dry air (CDA), nitrogen, and argon), a liquid (e.g., de-ionized water, an ammonia hydroxide solution, and a hydrogen fluoride solution,) or other fluid after polishing. Several embodiments of the transfer station 106 are described in more detail below with reference to FIG. 3.

The head portion 108 can include a frame 113, a plurality of shafts 114 extending from the frame 113, and a plurality of wafer carriers 116 individually coupled to the shafts 114. The head portion 108 can also include a driving mechanism (not shown) operatively coupled to the shafts 114 for rotating, reciprocating, and/or otherwise moving the individual wafer carriers 116 via the shafts 114. Individual wafer carriers 116 can carry a wafer facedown toward corresponding polishing pads 104 located on the base portion 102. The wafer carriers 116 can also be configured to dissipate electrostatic charge from the carried wafers. Various embodiments of the wafer carrier 116 are described in more detail below with reference to FIGS. 4A-D.

In operation, the transfer station 106 loads wafers facedown into individual wafer carriers 116. The driving mechanism in the head portion 108 and/or other driving mechanisms move the wafer carriers 116 and the corresponding polishing pads 104 relative to one another to rub the surface of the wafers against respective polishing pads 104. During polishing, the wafer carriers 116 can dissipate electrical charge from the carried wafers to ground via, e.g., the frame 113. As a result, the wafers may have a small or no electrostatic charge after being polished. The wafers are then loaded back into the transfer station 106. In one embodiment, the transfer station 106 can controllably release any remaining electrostatic charge from the polished wafers while holding the wafers. In another embodiment, the transfer station 106 can also contact the wafers with a liquid (e.g., de-ionized water) at a controlled pressure (e.g., less than about 40 psig.), and/or blow the wafers with a gas (e.g., nitrogen) to further process the wafers.

Several embodiments of the CMP machine 100 can reduce damage to the polished wafers caused by a sudden electrostatic discharge. The applicants have recognized that contacting and rubbing the wafers against the polishing pads 104 can impart electrostatic charge to the wafers. In conventional CMP machines, the pedestal is typically constructed from a metal, e.g., stainless steel. As a result, contacting the electrostatically charged polished wafers with the conductive pedestal can cause a sudden release of electrostatic charge via, e.g., sparking and/or arcing, which can short circuit electronic components formed in the wafers and/or physically damage the wafers. To reduce or eliminate such damage to the polished wafers, the applicants have developed apparatus and methods that can dissipate electrical charge from the wafers during polishing via the wafer carrier 116 and/or controlling the release of electrostatic charge after polishing via the pedestal 120.

Several embodiments of the CMP machine 100 can also reduce physical damage to the polished wafers caused by post-polishing processing. With conventional techniques, the polished wafers are typically washed with a liquid (e.g., de-ionized water) at pressures ranging between 40 to 60 psig. The applicants have also recognized that washing the wafers at such pressures can strip metal, polysilicon, silicon oxide, and/or other material from the surface of the wafers. This can cause pitting, delamination, and/or other physical damage. To resolve this problem, the applicants have developed processes and devices that can reduce or even eliminate such damage by controlling the pressure of the washing fluid to be less than about 40 psig and preferably about 15-20 psig.

Figure 3:
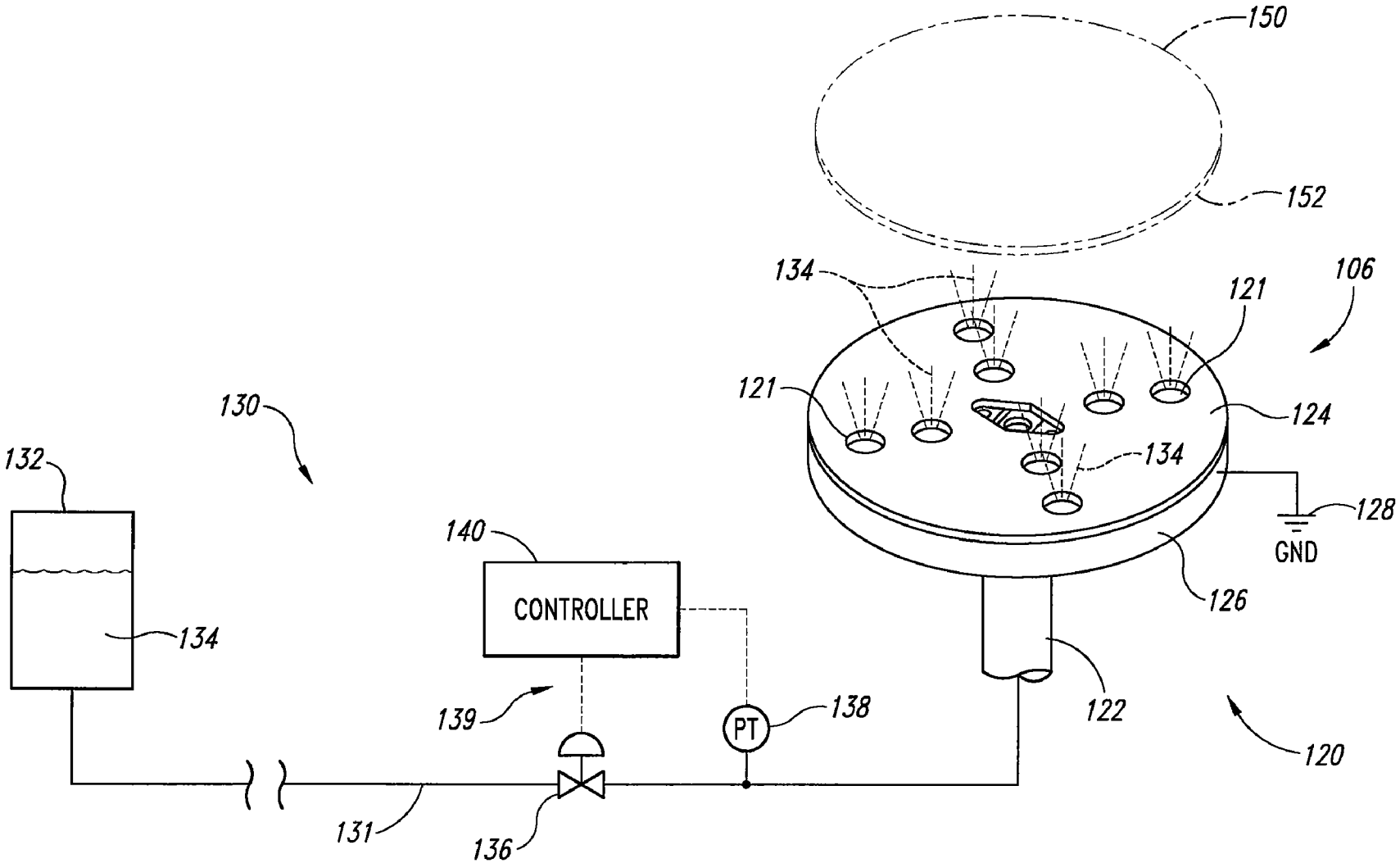
FIG. 3 is a partially schematic, isometric view of a portion of a transfer station suitable for use in the CMP machine of FIG. 2.

FIG. 3 is a partially schematic, isometric view of a portion of a transfer station 106 suitable for use in the CMP machine 100 of FIG. 2. The transfer station 106 can include a pedestal 120 operatively coupled to and supported by a spindle 122. FIG. 3 also illustrates a wafer 150 (shown in phantom lines for clarity) proximate to the pedestal 120. The wafer 150 can include a wafer surface 152 that can contact the pedestal 120 during loading/unloading or can be spaced apart from the pedestal 120 during post-polishing processing.

The pedestal 120 can be a plate constructed from an electrostatic dissipative interface 124 and a conductive support 126 connected to ground 128. The interface 124 can be proximate to the wafer 150, and the support 126 can be proximate to the spindle 122. The interface 124 can be a film deposited on the support 126 using printing, chemical vapor deposition, atomic layer deposition, and/or other suitable techniques. The interface 124 can also be a plate or other interface member fastened to the support 126 using an adhesive, a mechanical fastener, and/or other suitable coupling devices. At least the interface 124 is constructed from an electrostatic dissipative material that can transfer charge to ground with a dissipating time longer than a conductive material, but shorter than an insulating material. The static dissipative material can thus have an electrical resistance between a conductive material and an insulating material. For example, the static dissipative material can have a surface resistivity of about $1\times10^5$ to about $1\times10^{12}$ ohms and a volume resistivity of about $1\times10^4$ to about $1\times10^{11}$ ohm-cm. One particular example of an electrostatic dissipative material is the LEXAN® polycarbonate resin supplied by the General Electric Co. of Fairfield, Conn.

The pedestal 120 can reduce or even prevent a sudden electrostatic discharge when the wafer 150 is proximate to the pedestal 120. Without being bound by theory, it is believed that the electrostatic dissipative material in the pedestal 120 can have a sufficiently high electrical resistance such that induction on the pedestal 120 can be at least reduced, but also have sufficient conductivity to conduct the charge from the wafer 150 to ground. As a result, the pedestal 120 can mitigate high voltage drops from the wafer 150 that can cause sparking and/or other forms of sudden electrical discharge while also controllably releasing electrostatic charge from the wafer 150 to ground.

Even though the pedestal 120 described above includes a support and a separate interface, in certain embodiments, however, the pedestal 120 can include only a support constructed from an electrostatic dissipative material and connected to ground. In other embodiments, the support 126 can include more than two components. For example, the support 126 can include a base composed of an insulative or electrostatic dissipative material and a platform composed of a conductive material. The platform can be connected to ground, and an electrostatic dissipative interface can be on the platform.

In several embodiments, the pedestal 120 can also include a plurality of optional fluid ports 121 in the support 126 and through the interface 124. The fluid ports 121 have openings facing the wafer surface 152. The fluid ports 121 can be connected to a fluid system 130 via a line 131 to deliver processing fluid(s) to a wafer. The fluid system 130 can include a storage 132 for holding processing fluid 134 and a pressure control system 139 in the line 131. The processing fluid 134 can include de-ionized water, an ammonia hydroxide solution, a hydrogen fluoride solution, nitrogen, and/or other suitable fluids.

The pressure control system 139 can include a controller 140 (shown schematically) operatively coupled to a control valve 136 (e.g., a globe valve) and a pressure sensor 138 (e.g., a pressure transmitter) in the line 131. The pressure control system 139 can also optionally include an operator panel (not shown) to accept user input and/or to output information. The controller 140 can be a single-loop controller, a process logic controller, a system logic controller, and or other logic controller. The controller 140 can also include a computer-readable medium containing instructions (e.g., proportional-integral-differential control loops) for controlling a pressure of the processing fluid 134 supplied to the fluid ports 121. In certain embodiments, the flow of the processing fluid 134 can also be controlled using other process parameters (e.g., a volume flow rate, a mass flow rate, etc.) in addition to or in lieu of the measured pressure.

In operation, the fluid system 130 and the pedestal 120 can wash and/or otherwise treat the wafer 150 by contacting the wafer surface 152 with the processing fluid 134 at a desired pressure (e.g., less than about 40 psig and preferably about 15-20 psig). For example, an operator can enter a desired pressure range or setpoint in the controller 140, and the pressure sensor 138 can continuously measure the pressure of the processing fluid 134 in the line 131 and provide an electrical signal representing the measured pressure to the controller 140. The controller 140 can then adjust the control valve 136 to pressurize the processing fluid 134 at the pressure range or setpoint entered by the operator.

Without being bound by theory, it is believed that contacting the wafer surface 152 with a fluid at pressures less than about 40 psig can reduce electrostatic charge on the wafer 150. It is believed that if the fluid pressure is high (e.g., at 40 to 60 psig,) the fluid is likely atomized when discharged from the fluid ports 121. The atomized fluid particles are believed to have insufficient charge carrying capacity and/or contact time with the wafer to adequately reduce electrostatic charge on the wafer 150. However, by reducing the fluid pressure, the fluid can flow from the fluid ports 121 as streams of fluid, not as atomized particles. The streams are believed to have sufficient charge carrying capacity and/or contact time with the wafer 150 to neutralize or reduce electrostatic charge on the wafer 150.

The pressure control system 139 can also have other configurations. For example, the pressure control system 139 can include a pressure gauge and a manual valve in lieu of the controller 140. An operator can manually adjust the valve based on a reading of the pressure gauge. In another example, the pressure control system 139 can include a pressure regulator instead of the control valve 136 and the pressure transmitter 138. The pressure regulator can be manually set to a desired pressure. In a further example, the pressure control system 139 can include an orifice, a venturi, a nozzle, and/or other flow restricting component in the line 131. The restricting component can be calibrated to deliver a desired pressure at the fluid ports 121.

Figure 4A:
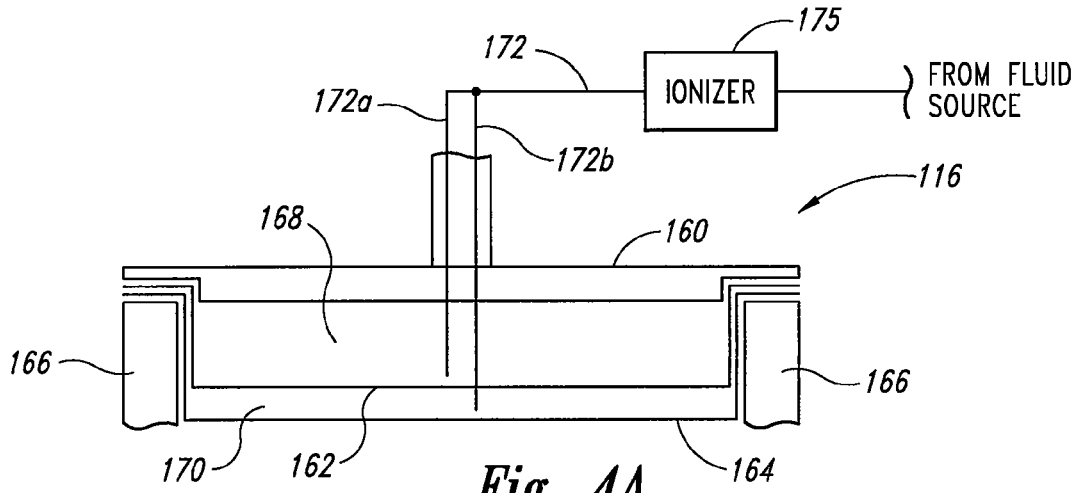
FIGS. 4A-C are partially schematic, cross-sectional views of embodiments of a wafer carrier suitable for use in the CMP machine of FIG. 2.
Figure 4B:
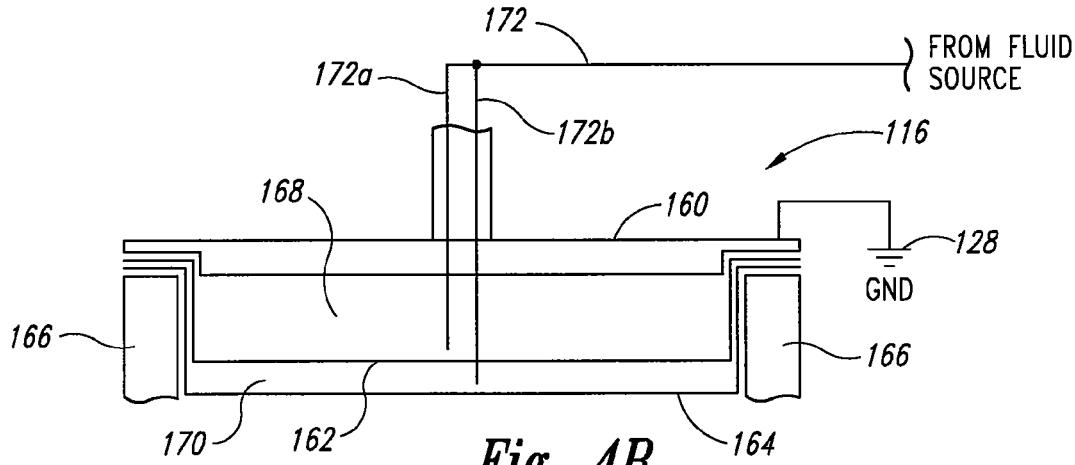
Figure 4C:
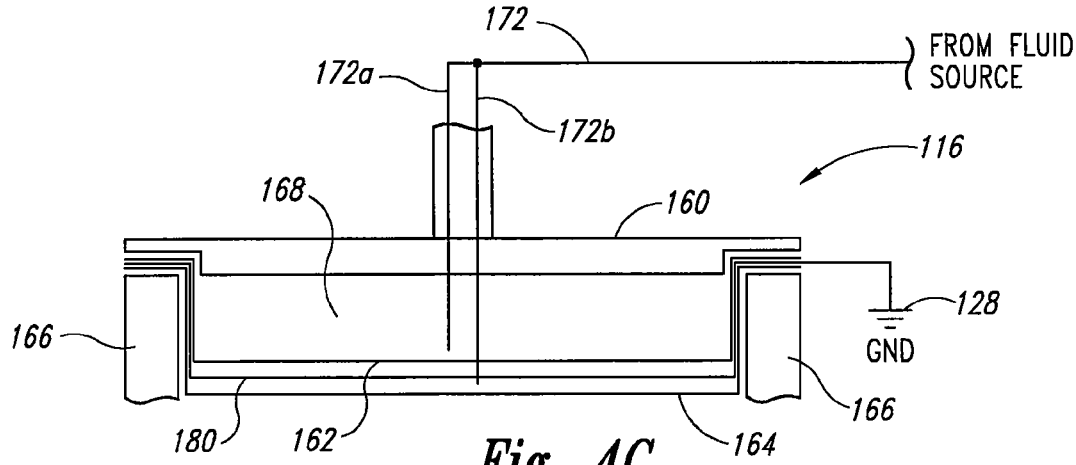

FIGS. 4A-C are partially schematic, cross-sectional views of embodiments of a wafer carrier 116 suitable for use in the CMP machine 100 of FIG. 2. The wafer carrier 116 can include a base 160, a first membrane 162, a second membrane 164, and a retainer 166 cooperating with the base 160 to hold the first and second membranes 162, 164 together. A first space 168 is between the base 160 and the first membrane 162, and a second space 170 is between the first and second membranes 162, 164. The first space 168 and the second space 170 are in fluid communication with a fluid source (not shown) via a supply line 172 having a first supply branch 172*a* and a second supply branch 172*b*. The fluid source can hold CDA, nitrogen, argon, and/or other suitable actuating fluid. In operation, the wafer carrier 116 can carry or impart a positive force on a wafer (not shown) proximate to the second membrane 164 by drawing a vacuum or pressurizing the first and/or second spaces 168, 170.

In one embodiment, as illustrated in FIG. 4A, the wafer carrier 116 can also include an ionizer 175 in the supply line 172 for ionizing the fluid flowing from the fluid source to the first and second spaces 168, 170. The ionizer 175 can be an in-line Alpha ionizer and/or a corona ionizer (e.g., an alternating current ionizer, a steady-state direct current ionizer, a pulsed direct current ionizer, etc.) One particular example of an Alpha ionizer is the in-line ionizer (Model No. P-2021) supplied by NRD, LLC. of Grand Island, N.Y.

In operation, the ionizer 175 can impart positive and/or negative charges on the originally neutral fluid particles passing through the ionizer 175. For example, when the ionizer 175 includes an in-line Alpha ionizer, the ionizer 175 uses an alpha particle emitter (e.g., polonium 210) to emit nuclei (e.g., helium nuclei) into the fluid particles. The emitted nuclei collide with the fluid molecules to "knock" electrons from one molecule to another. As a result, a generally balanced quantities of positive and negative ions of the fluid molecules are produced. The ionized fluid can then flow to the first and second spaces 168, 170 during and/or after polishing the wafer to absorb electrostatic charge from the first and second membranes 162, 164, and/or the carried wafer.

In another embodiment, as illustrated in FIG. 4B, the first and/or second membranes 162, 164 can be constructed from an electrostatic dissipative or a generally conductive material. The first and/or second membranes 162, 164 are accordingly composed of a material that is at least partially conductive and connected to the ground 128. For example, the first and/or second membranes 162, 164 can be constructed from a polymeric material embedded and/or coated with metal particles, carbon nanofibers, and/or other conductive material. The conductivity of the embedded polymeric material can be selected by adjusting the composition and/or concentration of the embedded material. In operation, the first and second membranes 162, 164 can continuously and controllably conduct electrical charge away from the wafer to the ground 128.

In a further embodiment, as illustrated in FIG. 4C, the wafer carrier 116 can include a conductive layer 180 between the first and second membranes 162, 164. The conductive layer 180 is electrically coupled to the first and second membranes 162, 164. In the illustrated embodiment, a wire connects the conductive layer 180 to the ground 128. In other embodiments, the conductive layer 180 can be grounded via the base 160, the retainer 166, and/or other components of the wafer carrier 116.

The conductive layer 180 can be a generally circular disk constructed from a metal (e.g., aluminum, copper, and zinc), a metal alloy (e.g., brass, bronze, and stainless steel), and/or other conductive material. In other embodiments, the conductive layer 180 can also be at other locations. For example, the conductive layer 180 can be in the first space 168 and proximate to the first membrane 162. A conductive link (e.g., a copper wire) can electrically connect the conductive layer 180 to the second membrane 164.

Figure 4D:
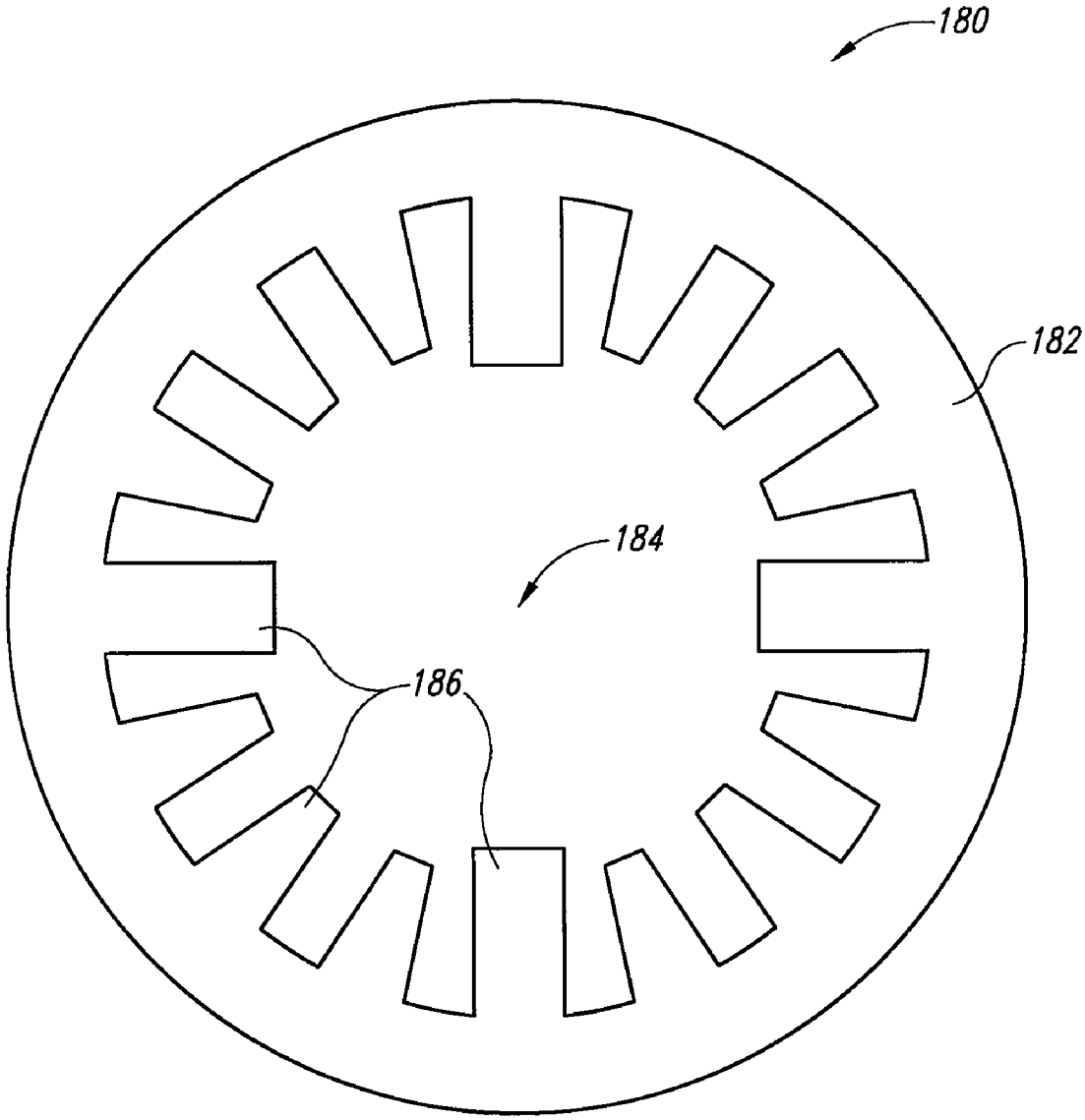
FIG. 4D is a top view of a conductive layer suitable for use in the wafer carrier of FIG. 4C.

In certain embodiments, the conductive layer 180 can have a hollowed configuration. For example, as illustrated in FIG. 4D, the conductive layer 180 can include a peripheral portion 182, a central portion 184, and a plurality of protrusions 186 extending from the peripheral portion 182 toward the central portion 184. The protrusions 186 can have similar or different shapes and sizes between one another. In other embodiments, the conductive layer 180 can have a solid configuration.

Several embodiments of the wafer carrier 116 can carry a wafer without generating electrostatic charge on the wafer. The applicants have identified the first and second membranes 162, 164 as a source of electrostatic charge; more specifically, the two membranes 162, 164 may generate electrostatic charge when they contact one another during processing. The electrostatic charge can then induce and/or otherwise cause the wafer to acquire electrostatic charge. Thus, in the embodiment shown in FIG. 4A, ionizing the actuating fluid can at least partially neutralize charge generated in the first and/or second membranes 162, 164. In the embodiments shown in FIG. 4B-D, the at least partially conductive membranes 162, 164 and/or the conductive layer 180 can continuously conduct any generated charge to the ground 128, and thus reduce electrostatic charge buildup on the membranes 162, 164 and/or the wafer.

From the foregoing, it will be appreciated that specific embodiments of the invention have been described herein for purposes of illustration, but that various modifications may be made without deviating from the invention. For example, many of the elements of one embodiment may be combined with other embodiments in addition to or in lieu of the elements of the other embodiments. Moreover, unless the word "or" is expressly limited to mean only a single item exclusive from the other items in reference to a list of two or more items, then the use of "or" in such a list means including (a) any single item in the list, (b) all of the items in the list, or (c) any combination of the items in the list. Additionally, the term "comprising" is used throughout the following disclosure to mean including at least the recited feature(s) such that any greater number of the same feature and/or additional types of features or components is not precluded. Accordingly, the invention is not limited except as by the appended claims.

We claim:

1. A chemical-mechanical polishing machine, comprising:

a polishing pad;

a wafer carrier configured to carry a semiconductor wafer in contact with the polishing pad;

a transfer station proximate to the polishing pad for holding the wafer during loading and/or unloading; and wherein at least one of the wafer carrier and the transfer station is configured to dissipate electrostatic charge from the wafer;

wherein the transfer station includes a pedestal having an interface facing the wafer and a support proximate to the interface, the interface being constructed from an electrostatic dissipative material having a surface resistivity of about $1\times10^5$ to about $1\times10^{12}$ ohms and a volume resistivity of about $1\times10^4$ to about $1\times10^{11}$ ohm-cm; and wherein the support is conductive and is electrically grounded.

2. The chemical-mechanical polishing machine of claim 1 wherein the pedestal of the transfer station includes a plurality of fluid ports facing the wafer.

3. The chemical-mechanical polishing machine of claim 1 wherein the pedestal of the transfer station includes a plurality of fluid ports facing the wafer, and wherein the chemical-mechanical polishing machine further includes a fluid supply system in fluid communication with the fluid ports via a supply line, the fluid supply system including a pressure control system for adjusting a pressure of the fluid supplied to the fluid ports.

4. The chemical-mechanical polishing machine of claim 1 wherein the wafer carrier includes a base, a first membrane spaced apart from the base by a first space, a second membrane spaced apart from the first membrane by a second space, and a retainer cooperating with the base to hold the first and second membranes together, the first space and the second space being in fluid communication with a fluid source via a first supply line and a second supply line, respectively, and wherein the chemical-mechanical polishing machine further includes an ionizer in at least one of the first and second supply lines.

5. The chemical-mechanical polishing machine of claim 4 wherein the ionizer includes at least one of an Alpha ionizer, an alternating current ionizer, a steady-state direct current ionizer, and a pulsed direct current ionizer.

6. The chemical-mechanical polishing machine of claim 1 wherein the wafer carrier includes a base, a first membrane spaced apart from the base, a second membrane spaced apart from the first membrane, and a retainer cooperating with the base to hold the first and second membranes together, at least one of the first and second membranes being at least partially conductive.

7. The chemical-mechanical polishing machine of claim 1 wherein the wafer carrier includes a base, a first membrane spaced apart from the base, a second membrane spaced apart from the first membrane, and a retainer cooperating with the base to hold the first and second membranes together, at least one of the first and second membranes being embedded and/or coated with an at least partially conductive material.

8. The chemical-mechanical polishing machine of claim 7 wherein the at least partially conductive material includes metal particles and/or carbon nanofibers.

9. The chemical-mechanical polishing machine of claim 7 wherein at least one of the first and second membranes is electrically grounded.

10. The chemical-mechanical polishing machine of claim 1 wherein the wafer carrier includes a base, a first membrane spaced apart from the base, a second membrane spaced apart from the first membrane, a conductive layer, and a retainer cooperating with the base to hold the conductive layer, the first membrane, and second membrane together, the conductive layer being in electrical communication with the first and second membranes.

11. The chemical-mechanical polishing machine of claim 10 wherein the conductive layer is between the first and second membranes.

12. A chemical-mechanical polishing machine, comprising:

a head portion carrying a plurality of polishing pads and a transfer station proximate to the polishing pads, the transfer station being configured to store a semiconductor wafer and controllably release electrostatic charge on the wafer; and a base portion rotatably coupled to the head portion, the base portion carrying a plurality of wafer carriers individually corresponding to the polishing pads;

wherein the transfer station includes a pedestal having a plurality of fluid ports facing the wafer, and wherein the chemical-mechanical polishing machine further includes a fluid supply system in fluid communication with the fluid ports via a supply line, the fluid supply system including a pressure control system for adjusting a pressure of the fluid supplied to the fluid ports to be less than about 40 psig; and wherein the pressure control system includes a controller having a computer-readable medium containing instructions for monitoring a fluid pressure in the supply line, accepting a pressure setpoint from an operator, and moving the measured fluid pressure toward the pressure setpoint, and wherein the transfer station includes a pedestal constructed from an electrostatic dissipative material having a surface resistivity of about $1\times10^5$ to about $1\times10^{12}$ ohms and a volume resistivity of about $1\times10^4$ to about $1\times10^{11}$ ohm-cm.

13. A chemical-mechanical polishing machine, comprising:

a polishing pad;

a wafer carrier configured to carry a semiconductor wafer in contact with the polishing pad; and a transfer station proximate to the polishing pad for holding the wafer during loading and/or unloading, the transfer station including a pedestal configured to carry the semiconductor wafer and controllably release electrostatic charges from the semiconductor wafer to ground without sparking and/or arcing, wherein:

the pedestal includes an interface plate facing the wafer and a support coupled to the interface plate, the interface plate being constructed from an electrostatic dissipative material having a surface resistivity of about $1\times10^5$ to about $1\times10^{12}$ ohms and a volume resistivity of about $1\times10^4$ to about $1\times10^{11}$ ohm-cm, the support being electrically grounded;

the pedestal also includes a plurality of fluid ports facing the semiconductor wafer;

the chemical-mechanical polishing machine further includes a fluid supply system in fluid communication with the fluid ports via a supply line, the fluid supply system including a pressure control system that includes a control valve, a pressure sensor, and a controller operatively coupled to the control valve and the pressure sensor, the controller having a computer-readable medium containing instructions for monitoring a fluid pressure measured by the pressure sensor, accepting a pressure setpoint from an operator, and regulating the control valve to move the fluid pressure toward the pressure setpoint of about 15-20 psig.

14. The chemical-mechanical polishing machine of claim 13 wherein the interface plate has sufficiently high electrical resistance such that induction on the pedestal is at least reduced while having sufficient conductivity such that the electrostatic charges are released from the semiconductor wafer to ground without sparking and/or arcing.

15. The chemical-mechanical polishing machine of claim 13 wherein the pedestal includes a plurality of fluid ports facing the wafer; and the chemical-mechanical polishing machine further includes a fluid supply system in fluid communication with the fluid ports via a supply line, the fluid supply system including a pressure control system for adjusting a pressure of the fluid supplied to the fluid ports, wherein the pressure control system includes a control valve, a pressure sensor, and a controller operatively coupled to the control valve and the pressure sensor, the controller having a computer-readable medium containing instructions for monitoring a fluid pressure measured by the pressure sensor, accepting a pressure setpoint from an operator, and regulating the control valve to move the fluid pressure toward the pressure setpoint of less than about 40 psig.

16. A chemical-mechanical polishing machine, comprising:

a polishing pad;

a wafer carrier configured to carry a semiconductor wafer in contact with the polishing pad; and a transfer station proximate to the polishing pad for holding the semiconductor wafer during loading and/or unloading, the transfer station including a pedestal having an interface facing the wafer and a support proximate to the interface, the interface being constructed from an electrostatic dissipative material, the support being conductive and electrically grounded, wherein the pedestal is constructed from an electrostatic dissipative material having a surface resistivity of about $1\times10^{5}$ to about $1\times10^{12}$ ohms and a volume resistivity of about $1\times10^{4}$ to about $1\times10^{11}$ ohm-cm.

* * * * *